US007247787B2

(12) United States Patent
Aoki

(10) Patent No.: US 7,247,787 B2
(45) Date of Patent: Jul. 24, 2007

(54) ELECTRONIC MUSICAL INSTRUMENT

(75) Inventor: Norihisa Aoki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 389 days.

(21) Appl. No.: 10/805,107

(22) Filed: Mar. 19, 2004

(65) Prior Publication Data

US 2004/0187671 A1 Sep. 30, 2004

(30) Foreign Application Priority Data

Mar. 24, 2003 (JP) ..... 2003-079278

(51) Int. Cl.
*G10H 1/06* (2006.01)
*G10H 7/00* (2006.01)

(52) U.S. Cl. ..... 84/622; 84/615

(58) Field of Classification Search ..... 84/600, 84/615, 653, 622, 659
See application file for complete search history.

(56) References Cited

U.S. PATENT DOCUMENTS 5,220,117 A * 6/1993 Yamada et al. ..... 84/600
5,420,374 A * 5/1995 Hotta ..... 84/622
5,554,814 A * 9/1996 Nakata ..... 84/659
5,728,961 A * 3/1998 Tamura ..... 84/600
5,731,534 A * 3/1998 Tamura et al. ..... 84/662
6,492,584 B2 * 12/2002 Ikeya ..... 84/615
2003/0131712 A1 * 7/2003 Torimura ..... 84/477 R
2003/0131719 A1 * 7/2003 Kubita ..... 84/615

FOREIGN PATENT DOCUMENTS

JP 11-073185 3/1999

* cited by examiner

*Primary Examiner*—Jeffrey W Donels
(74) *Attorney, Agent, or Firm*—Morrison & Foerster LLP

(57) ABSTRACT

An electronic musical instrument is composed of a main body portion and parts such as an upper keyboard, a lower keyboard, and so on that are selected from among parts of a high-grade and low-grade in accordance with the model thereof and placed in the main body portion, in which a ROM stores control programs necessary for control of the electronic musical instrument of the high-grade model and low-grade model so that a CPU selects any of these and executes it. The selection is performed in accordance with an ON/OFF state of a limit switch provided to correspond to one of the parts. A portion of the part is made to have a different shape depending on the grade, so that when the part is placed in the main body portion, the limit switch comes into an ON/OFF state in accordance with the grade of the part.

13 Claims, 8 Drawing Sheets

ELECTRONIC MUSICAL INSTRUMENT

BACKGROUND OF THE INVENTION

1. Field of the Invention

The invention relates to an electronic musical instrument constituted by placing parts such as a keyboard portion, a sound source portion, and so on in a main body portion and, more specifically, to an electronic musical instrument in which a part selected from among parts of a plurality of grades can be placed and which can be changed in grade by replacement of the part.

2. Description of the Related Art

Generally, to meet wide-ranging needs of consumers, it is often to provide electronic musical instruments such as an electronic organ and so on by a plurality of kinds of models of different grades from a high-grade model that is highly functional at a high price to a low-grade model that is less functional at a low price. There is a known electronic organ as the above-described one, for example, by the name of "Electone (trade mark)" manufactured and sold by the assignee of this application. For development of such an electronic musical instrument, it takes much cost to independently develop and manufacture each model, and therefore a method is employed in which portions that can be made common among the models are made common and different parts are placed in a common portion in accordance with the function. The employment of such a method enables an electronic musical instrument to be upgraded without replacement of the common portion only by replacing parts of the low-grade model with parts corresponding to the high-grade model.

However, when such an upgrade is performed, there is a problem of updating the control program. As for this point, since the same CPU or the like, which constitutes the controller, is often usable as hardware itself even in different grades, the CPU is often provided in the common potion. Then, in an electronic musical instrument manufactured as the low-grade model, the control portion performs control using, as a matter of course, a control program for controlling the common portion and the parts of the low-grade model. In this event, even through only the parts are replaced with those of the high-grade model, the controller cannot control the new parts if the control program for use in control is unchanged. Therefore, it is also necessary to conduct work of rewriting the control program or replacing a program ROM storing the control program at the time of upgrade.

As means for solving such a problem, a configuration is described in paragraphs 0024 to 0026 of JP, H11-73185, A, in which a ROM stores in advance a control program for making an electronic musical instrument function as a high-grade model and a control program for making it function as a low-grade model, and an external DIP switch sets which model function the electronic musical instrument performs.

According to this configuration, when the electronic musical instrument is upgraded by replacement of parts, the setting of the DIP switch is changed in accordance with the upgrade to thereby change the control program so that the controller can control the parts after the replacement.

However, in the configuration described in the above publication, it is necessary to change the setting of the switch at the time of upgrade, which leads to a problem that the electronic musical instrument does not normally operate when the change operation is forgotten.

In addition, there is a constraint on design that the DIP switch should be placed at an operable position, and the DIP switch located at a position where the operation is not easy increases the labor of upgrade work. On the other hand, there is another problem that when the switch is located at a position where it is too conspicuous and therefore a user operates it by mistake, the control program is unintentionally changed, whereby the electronic musical instrument does not normally operate.

Further, there is another problem that a change of the DIP switch changes which model function the whole electronic musical instrument performs, and this configuration cannot cope with the case of individual upgrade of the parts.

SUMMARY OF THE INVENTION

It is an object to the invention to solve the above-described problems so as to make it possible, in an electronic musical instrument comprising a main body portion and a part selected from among parts of a plurality of grades and placed in the main body portion, to reliably change the control program for use in control to an appropriate one when the grade of the electronic musical instrument is changed by replacement of the parts, and to make no change in other cases. It is another object to make it possible to change the control program even when only part of the parts are replaced.

To attain the above objects, the invention is an electronic musical instrument comprising a main body portion and at least one part selected from among parts of a plurality of grades in accordance with a model of the electronic musical instrument and placed in the main body portion, wherein the main body portion includes: a memory for storing control programs necessary for control of the electronic musical instrument for respective models of the electronic musical instrument; a controller for controlling the electronic musical instrument using the control program; and a selector for selecting a control program to be used for control by the controller from among the control programs stored in the memory, and wherein the selector includes a switch provided to correspond at least to one of the parts and coming into a state in accordance with the grade of the part when the part is placed in the main body portion.

It is preferable that such an electronic musical instrument further includes a restraining member corresponding to the switch, wherein the switch comes into a state in accordance with the grade of the part in accordance with a position of the restraining member.

Further, it is preferable that the selector selects a control program used for control by the controller in accordance with the position of the restraining member. Alternatively, it is preferable that the restraining member presses the switch so that the switch comes into a state in accordance with the grade of the part corresponding to the switch. Further, it is preferable that the pressing the switch by the restraining member shows that the part is of a high-grade.

Further, it is preferable that, in the above-described electronic musical instrument, when the part is placed in the main body portion, the part itself presses the switch to bring the switch into a state in accordance with the grade of the part.

Furthermore, it is adoptable that, in the above-described electronic musical instrument, the part includes a transmitter for transmitting information of the grade of the part to the main body portion in place of the above-described selector, and that the controller includes a selector for selecting a control program for use in control from among the control programs stored in the memory in accordance with the information transmitted by the transmitter.

The invention is an electronic musical instrument comprising a main body portion and a plurality of parts selected from among parts of a plurality of grades for each kind and placed in the main body portion, wherein the main body portion includes: a memory for storing control programs for controlling the parts of each selectable grade for each kind of part; and a controller for controlling the electronic musical instrument using the control program, and wherein each kind of part includes a transmitter for transmitting grade information of the part to the main body portion, and wherein the controller includes a selector for selecting a control program for use in control from among the control programs stored in the memory in accordance with the information transmitted by the transmitter for each kind of part.

In each of the above-described electronic musical instrument, it is preferable that the part includes a CPU as the transmitter so that the CPU communicates with the main body portion to transmit the grade information of the part to the main body portion.

Besides, it is also preferable to provide, in place of the above-described transmitter and selector for selecting a control program, a switch for selecting for each kind of part a control program to be used for control by the controller from among the control programs stored in the memory.

Further, it is also preferable that a controller recognizes grades of the parts placed in said main body portion for each kind, and includes a selector for selecting a control program for use in control from among the control programs stored in the memory in accordance with the recognized grades for each kind of part.

The above and other objects, features and advantages of the invention will be apparent from the following detailed description which is to be read in conjunction with the accompanying drawings.

DETAILED DESCRIPTION OF THE PREFERRED EMBODIMENTS

Hereinafter, preferred embodiments of the invention will be described with reference to the drawings.

First Embodiment FIG. 1 to FIG. 5D

Figure 1:
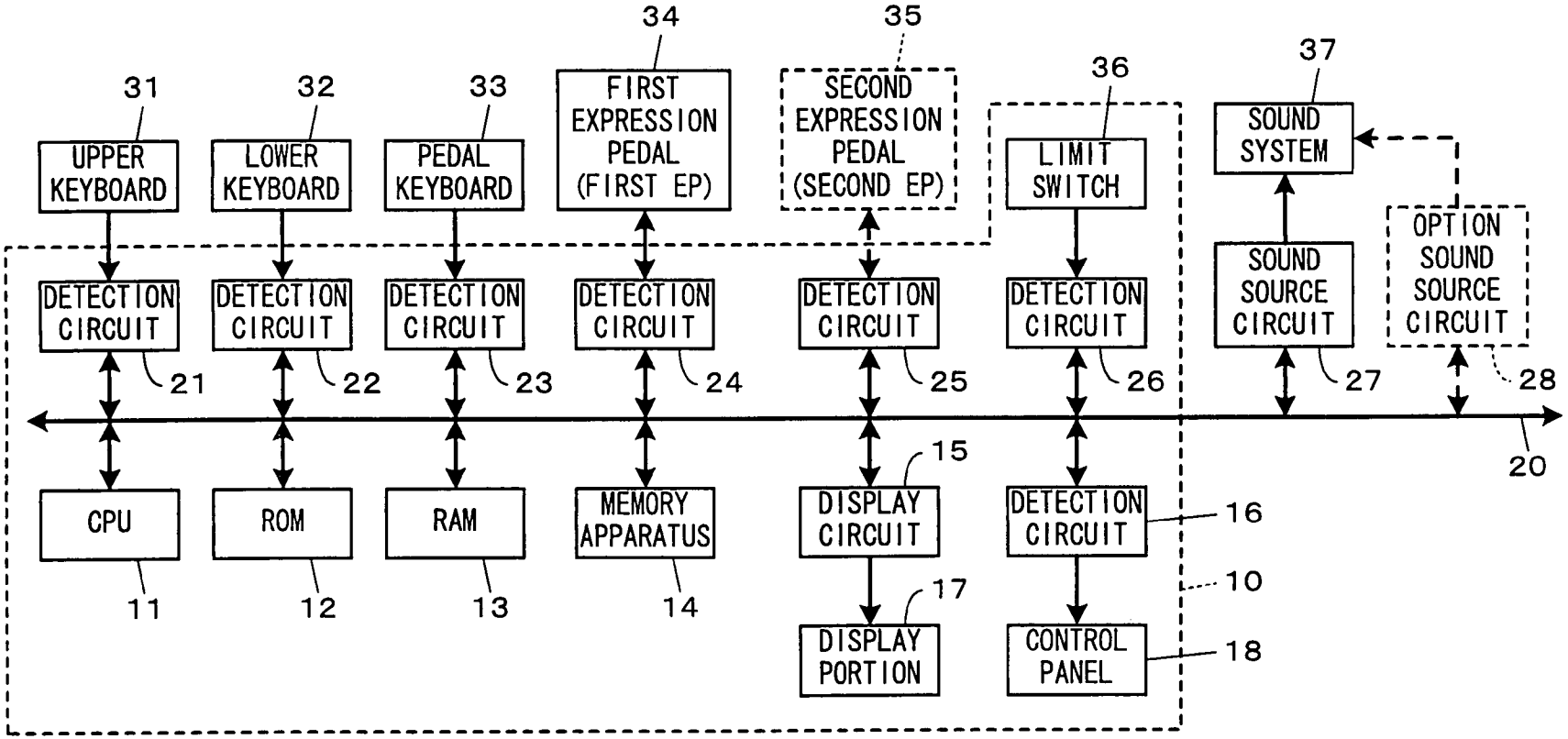
FIG. 1 is a block diagram showing a configuration of an electronic organ being a first embodiment of an electronic musical instrument of the invention.

An electronic organ being a first embodiment of an electronic musical instrument of the invention will be described first. FIG. 1 is a block diagram showing a configuration of the electronic organ.

This electronic organ is constituted by placing parts such as an upper keyboard 31, a lower keyboard 32, and so on in a main body portion 10 shown in FIG. 1. Then, parts of appropriate grades can be selected from among those of a plurality of grades and placed in the common main body portion 10 to constitute electronic organs of plural kind of models of different grades from a high-grade model that is highly functional at a high price to a low-grade model that is less functional at a low price.

In such an electronic organ, the main body portion 10 includes a CPU 11, a ROM 12, a RAM 13, a memory apparatus 14, a display circuit 15, detection circuits 16 and 21 to 26, which are connected by a system bus 20. Further, a display portion 17 connected to the display circuit 15, a control panel 18 connected to the detection circuit 16, a limit switch 36 connected to the detection circuit 26, and a not-shown casing that is a frame of the whole electronic organ are also included in the main body portion 10.

The CPU 11, which is a controller that comprehensively controls the whole electronic organ, executes a predetermined control program stored in the ROM 12 to thereby control read/write of data in the ROM 12, RAM 13, and memory apparatus 14, display on the display portion 17 by the display circuit 15, detection of operation and setting by each of the detection circuits 16 and 21 to 26, output of audio signals to a sound system 37 by a later-described sound source circuit 27 and option sound source circuit 28, and so on.

The ROM 12 is a non-volatile memory that stores preset data, the control program executed by the CPU 11, and so on. The control program stored here will be described in detail later.

The RAM 13 is a memory that stores temporarily necessary parameters for designating sound effects and accompaniment and is used as a work memory of the CPU 11.

The memory apparatus 14, which is composed of a hard disc drive, a flexible disc drive, a CD-ROM drive, and the like, is an apparatus for reading tone data, control program, and so on stored in a storage medium such as the flexible disc, CD-ROM, or the like and storing setting data set by a user. As a matter of course, it is unnecessary for the memory apparatus 14 to include all of the drives.

The display circuit 15 is a circuit that controls display on the display portion 17 based on the control data sent from the CPU 11. The display portion 17, which is composed of a liquid crystal panel, a light emitting diode (LED), or the like, is an apparatus for displaying information such as a message representing setting contents and action state.

The detection circuit 16 is an apparatus for detecting an operation signal from the control panel 18 connected thereto. The control panel 18, which includes controls implemented by various kinds of buttons, switches, dials, and so on, is a unit for a player to perform setting operation of tone, accompaniment pattern, various kinds of sound effects, and so on of sounds that are produced in accordance with operation of the keyboards and expression pedals (EPs). It should be noted that it is also adoptable to constitute the display portion 17 and control panel 18 as an integral unit.

The detection circuits 21 to 25 are apparatus for detecting operation signals from the upper keyboard 31, the lower keyboard 32, a pedal keyboard 33, a first EP 34, and a second EP 35 that are parts connected thereto respectively.

The detection circuit 26 is a circuit for detecting the state of the limit switch 36, and the limit switch 36 is a switch provided on a mother board of the electronic organ or connected to the mother board and functions as a selector for selecting a control program to be used for control of the electronic organ by the CPU 11.

As the parts to be placed in such a main body portion 10, the upper keyboard 31, lower keyboard 32, pedal keyboard 33, first EP 34, second EP 35, sound source circuit 27, option sound source circuit 28, and sound system 37 can be placed.

The upper keyboard 31, lower keyboard 32, and pedal keyboard 33 are three kinds of keyboards generally provided in an electronic organ. These keyboards are provided with various kinds of sensors such as a sensor for detecting the presence or absence and the speed of key press, a sensor for detecting the pressure of key press after the key press, a senor for detecting operation in the horizontal direction of keys, so that key press operation by the player is detected by these sensors and the contents are sent out as operation signals to the CPU 11 via the detection circuit 21 to 23. Depending on the grade, the sensors differ in sensitivity and presence/absence such that an electronic organ of a higher grade generally has a configuration capable of detecting more characteristics more finely. Further, it is also conceivable to make difference in operation feeling by changing the material and shape of parts or the like depending on the grade.

The first EP 34 and second EP 35 are foot pedals operated by foot, the first EP 34 being used for adjusting volume and the second EP 35 being used for adjusting pitch, speed, and so on. These EPs also include various kinds of sensors for detecting operations, so that the operation by the player is detected by these sensors and the contents are sent out as operation signals to the CPU 11 via the detection circuits 24 and 25. Similarly to the case of the keyboards, the presence or absence of the sensors and so on are different depending on the grade, and the second EP 35 is optional and there might be a case where the second EP 35 itself is not originally provided in a low-grade model. The reason why the second EP 35 is shown by a dotted line in FIG. 1 is to show this arrangement.

The sound source circuit 27 is a circuit that generates waveform data in accordance with an instruction of producing a sound from the CPU 11 and outputs the data to the sound system 37 composed of an amplifier, a speaker, and so on. The kinds of tones, the number of sounds capable of being concurrently produced, the kinds of corresponding effects, and so on stored in the sound source circuit 27 are different depending on the grade. Besides, the sound system 37 shall be common in all grades.

The option sound source circuit 28 is a sound source unit to be provided in addition to the sound source circuit 27. It is often to provide, as the option sound source circuit 28, a circuit that is more expensive and has higher performance than a standard sound source like, for example, a physical model sound source circuit or the like. This option sound source circuit 28 is also optional similarly to the second EP 35 and might not be provided in a low-grade model.

Owing to the above-described configuration, the CPU 11 detects operation signals from the keyboards and EPs and transmits a sound producing signal to the sound source circuit 27 or the option sound source circuit 28 based on the operation signals and set values by the control panel 18 to generate waveform data and transmit it to the sound system 37, whereby the electronic organ can perform a sound producing action based on the operation of the player.

In such an electronic organ, even a user who bought a low-grade model can upgrade it to a high-grade model by replacing only parts. This point will be described next. Note that this electronic organ will be described in a case of providing products of two models, that is, a high-grade model and a low-grade model as models using parts of grades shown in Table 1 for simplification of the description.

Here, the second EP 35 and option sound source circuit 28 are not placed in the electronic organ of the low-grade model, which shows that there are no parts corresponding to the low-grade model. Besides, the sound system 37 is common irrespective of the model, and it is acceptable to have such a common unit as long as there is at least one part that is different in accordance with the model.

Figure 2:
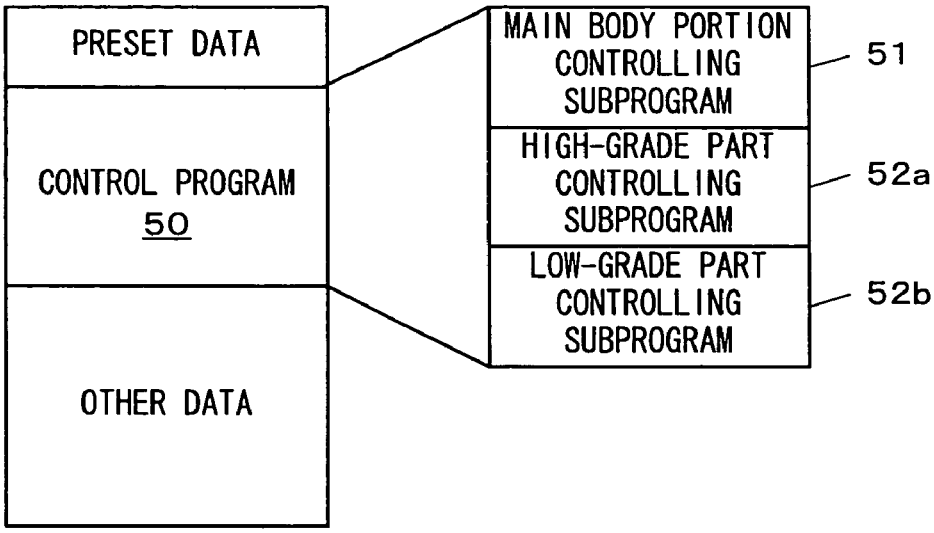
FIG. 2 is a diagram showing a configuration of data stored in a ROM of the electronic organ.

When providing such models, the ROM 12 stores, as a control program 50, a main body portion controlling subprogram 51, a high-grade part controlling subprogram 52*a*, and a low-grade part controlling subprogram 52*b* as shown in FIG. 2. They are control programs for controlling the main body portion 10, parts to be placed in the main body portion 10 in the high-grade model, and parts to be placed in the main body portion 10 in the low-grade model, respectively. However, a program for controlling common parts irrespective of the model such as the sound system 37 may be included in the main body portion controlling subprogram 51. The CPU 11 performs control using the programs 51 and 52*a* for the high-grade model and the programs 51 and 52*b* for the low-grade model.

In other words, the ROM 12 stores control programs necessary for controlling the electronic organ of each model to be provided irrespective of what grade parts are placed therein. Then, the CPU 11 selects an appropriate one from among these control programs at the time of start and executes it to thereby perform control, and the control program selected here is set in accordance with the state of the limit switch 36.

Figure 3:
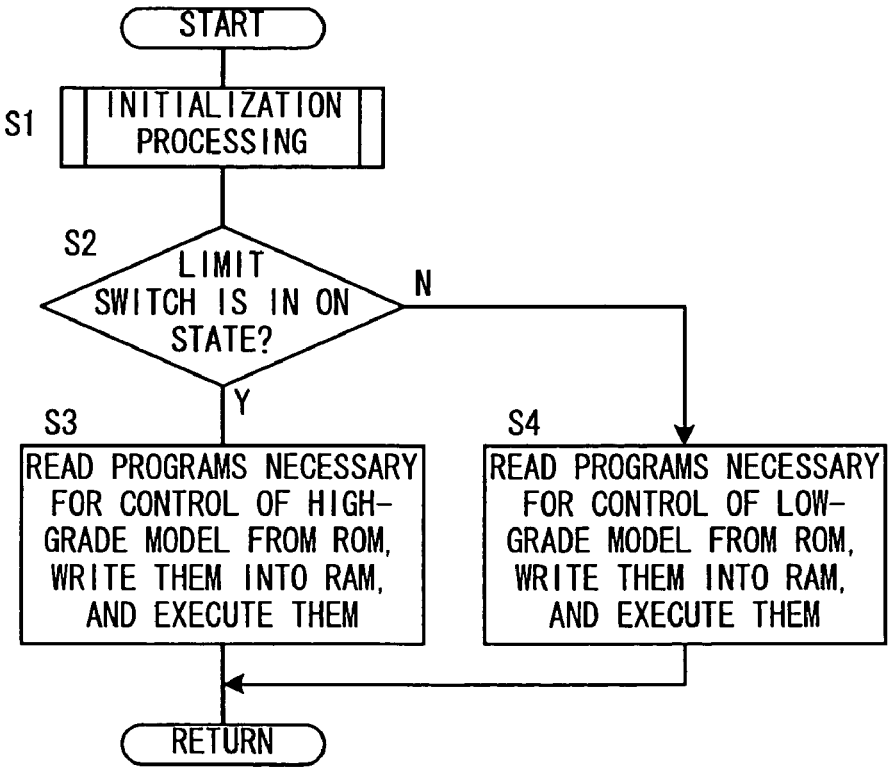
FIG. 3 is a flowchart showing control program selection processing in the electronic organ.

The processing is shown in the flowchart of FIG. 3.

When the power of the electronic organ is turned on, the CPU 11 executes a boot program included in the preset data to start the processing shown in the flowchart. Then, after performance of necessary initialization processing (S1), the CPU 11 judges the state of the limit switch 36 (S2). When it is in an ON state or an OFF state, the CPU 11 reads the programs 51 and 52*a* necessary for control of the high-grade model (S3) or the programs 51 and 52*b* necessary for control of the low-grade model (S4), respectively, from the ROM 12 and writes them into the RAM 13 and then executes them to thereby start the control action.

Such a limit switch 36 is provided in the casing portion of the main body portion 10, corresponding to at least one of the parts. Examples of the arrangement of limit switch 36 are shown in FIG. 4A to FIG. 4D, which show in plan views and front views the states of the limit switch 36 when the high-grade parts and the low-grade parts are placed respectively. In these drawings, numeral 19 denotes part of the casing of the main body portion 10, and numeral 30 denotes part of one of the parts. Further, the front views in FIG. 4B and FIG. 4D are shown with surfaces of the casings on the front side omitted for easy recognition of the drawings.

Figure 4A:
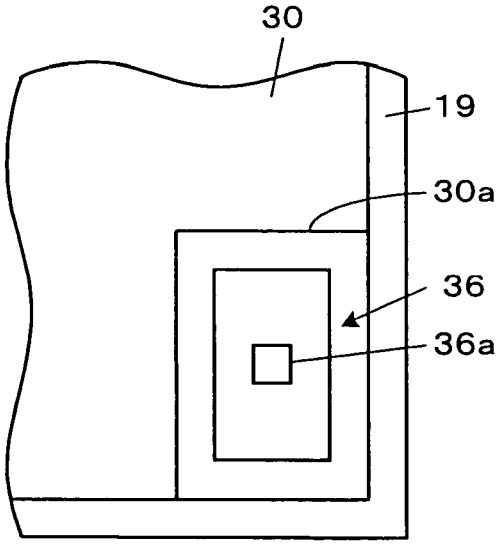
FIGS. 4A and 4B are a plan view and a front view showing an arrangement example of a limit switch in the electronic organ and a state of the limit switch when a high-grade part is placed, respectively.
Figure 4C:
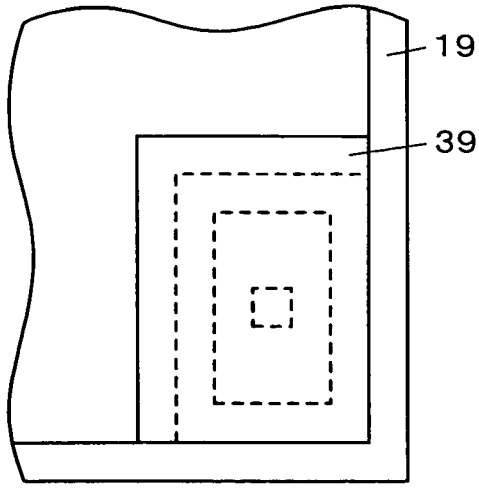
FIGS. 4C and 4D are a similar plan view and front view showing a state of the limit switch when a low-grade part is placed, respectively.
Figure 4B:
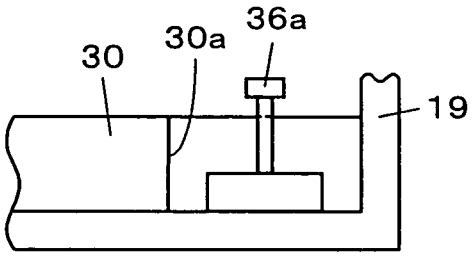
Figure 4D:
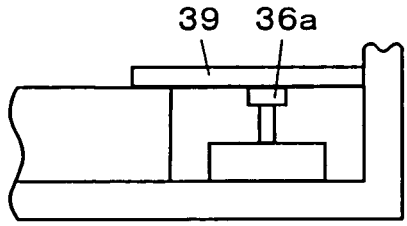
Figure 5A:
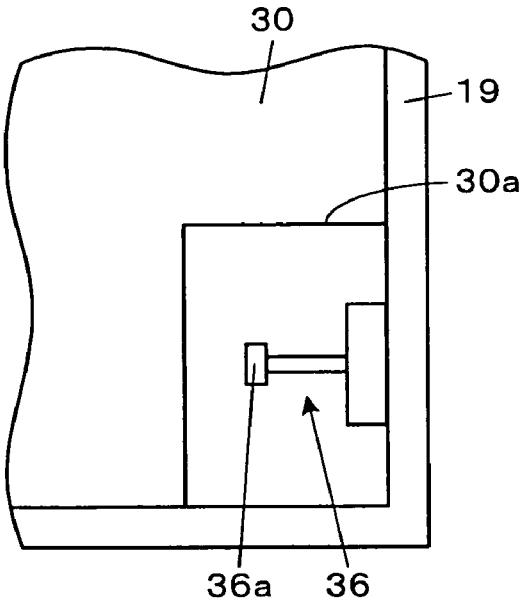
FIGS. 5A to 5D are plan views and front views, corresponding to FIG. 4A to FIG. 4D, showing other arrangement examples of the limit switch and configuration examples of parts corresponding thereto.
Figure 5C:
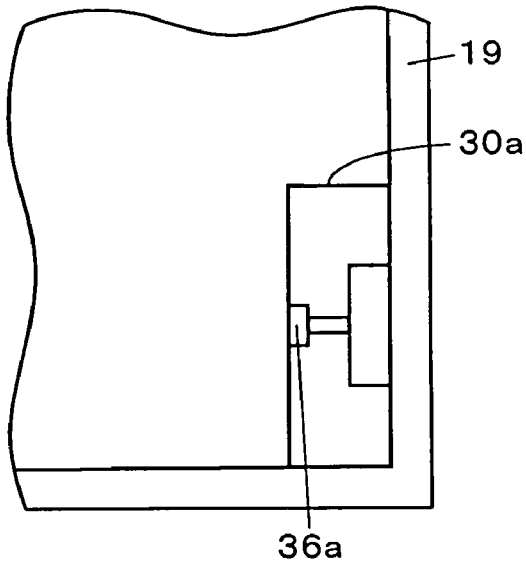
Figure 5B:
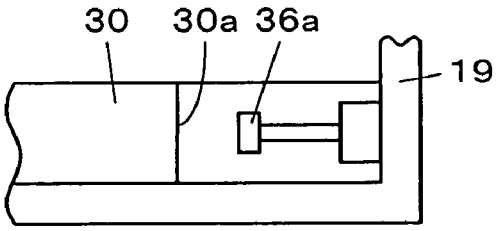
Figure 5D:
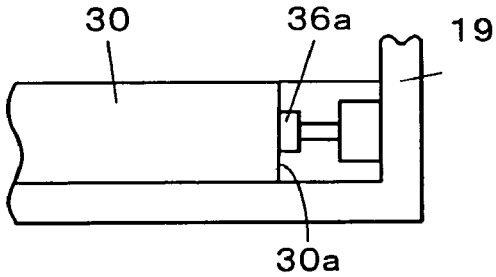

In this electronic organ, as shown in FIG. 4A to FIG. 4D, a cutout portion 30*a* is provided at the end of the board of the part 30, and the limit switch 36 is provided at a portion where the cutout portion 30*a* is located when the part 30 is placed in the casing 19 of the main body portion 10. FIG. 4A and FIG. 4B show a case in which the low-grade part is placed, in which case a top portion 36*a* of the limit switch 36 is kept free even when the part is placed in the casing 19, so that the limit switch 36 is in an OFF state.

Meanwhile FIG. 4C and FIG. 4D show a case in which the high-grade part is placed, in which case a restraining member 39 covering the cutout portion 30*a* of the part 30 is provided, so that when the part 30 is placed in the casing 19, the top portion 36*a* of the limit switch 36 is depressed (pressed) by the restraining member 39. In this state, the limit switch 36 is in an ON state.

Accordingly, when the part 30 is placed in the main body portion 10, the limit switch 36 is brought into an ON/OFF state in accordance with the grade of the part 30.

Further, another arrangement example of the limit switch 36 is shown in FIG. 5A to FIG. 5D. In these drawings, portions corresponding to those in FIG. 4A to FIG. 4D are assigned the same numbers. In the case of this example, the limit switch 36 is provided on a side wall of the casing 19 of the main body portion 10, and the width of the cutout portion 30*a* is made different between the high-grade part and the low-grade part. Also with such a configuration, it is possible to press the top portion 36*a* of the limit switch 36 by the end portion of the board into an ON state only in the case of placing the high-grade part, while bringing into an OFF state in which the top portion 36*a* of the limit switch 36 kept free in the case of placing the low-grade part. In such a configuration, there is no need to provide the restraining member 39.

However, when the low-grade model shown in Table 1 is upgraded to the high-grade model, a person in charge of a manufacturer removes the low-grade parts to replace with high-grade parts and newly places optional parts for the high-grade model. At this time, the limit switch 36 that has been in the OFF state when the low-grade parts are placed changes to an ON state by placing the high-grade parts, with no change operation performed in particular.

Accordingly, when the power is turned on after the replacement of the parts, the CPU 11 automatically selects the control program necessary for control of the high-grade model and reads it from the ROM 12 and executes it according to the processing shown in FIG. 3, so that the high-grade parts can be appropriately controlled to operate as a high-grade electronic organ. Further, it becomes possible to reliably change the control program for use in control to an appropriate one when the grade of the electronic musical instrument is changed by replacement of the parts, and to make no change in other cases.

Since it is assumed that all the parts are collectively replaced for complete upgrade in this embodiment, the limit switch 36 only needs to be provided at the position corresponding to one of the parts, and the whole control program to be used is set by this switch. Besides, it is preferable to provide the limit switch 36 at a position opposing a part having a large size to a certain degree as compared to the limit switch 36 as shown in FIG. 4A to FIG. 5D.

However, the shapes of the limit switch 36 and the part and positional relation therebetween are not limited to those shown in FIG. 4A to FIG. 5D. Further, it is also adoptable to use a switch other than the limit switch as long as it is a switch that comes into a state in accordance with the grade of a part, when the part is placed in the main body portion 10, without change operation in particular.

The control program for use itself is changed here depending on the grade, but if it is possible to cope with each grade by changing not the control program but only the parameters of the number of switches or the like, it is also adoptable to store parameters necessary for control of each grade, read different parameters in accordance with the state of the limit switch 36, and execute the control program using the parameter.

Besides, it is also adoptable not to provide the main body portion controlling subprogram 51 in the control program but to allow a portion corresponding thereto to be included in the control program for each model.

Furthermore, since there are two kinds of grades in model here, only one binary limit switch is used to set the control program for use, but when there are three kinds or more of grades in model, a plurality of switches may be provided so that the control program for use may be set by combination of these switches. In this case, it is necessary to provide the switches at positions corresponding to parts of different grades used in all models.

Figure 6:
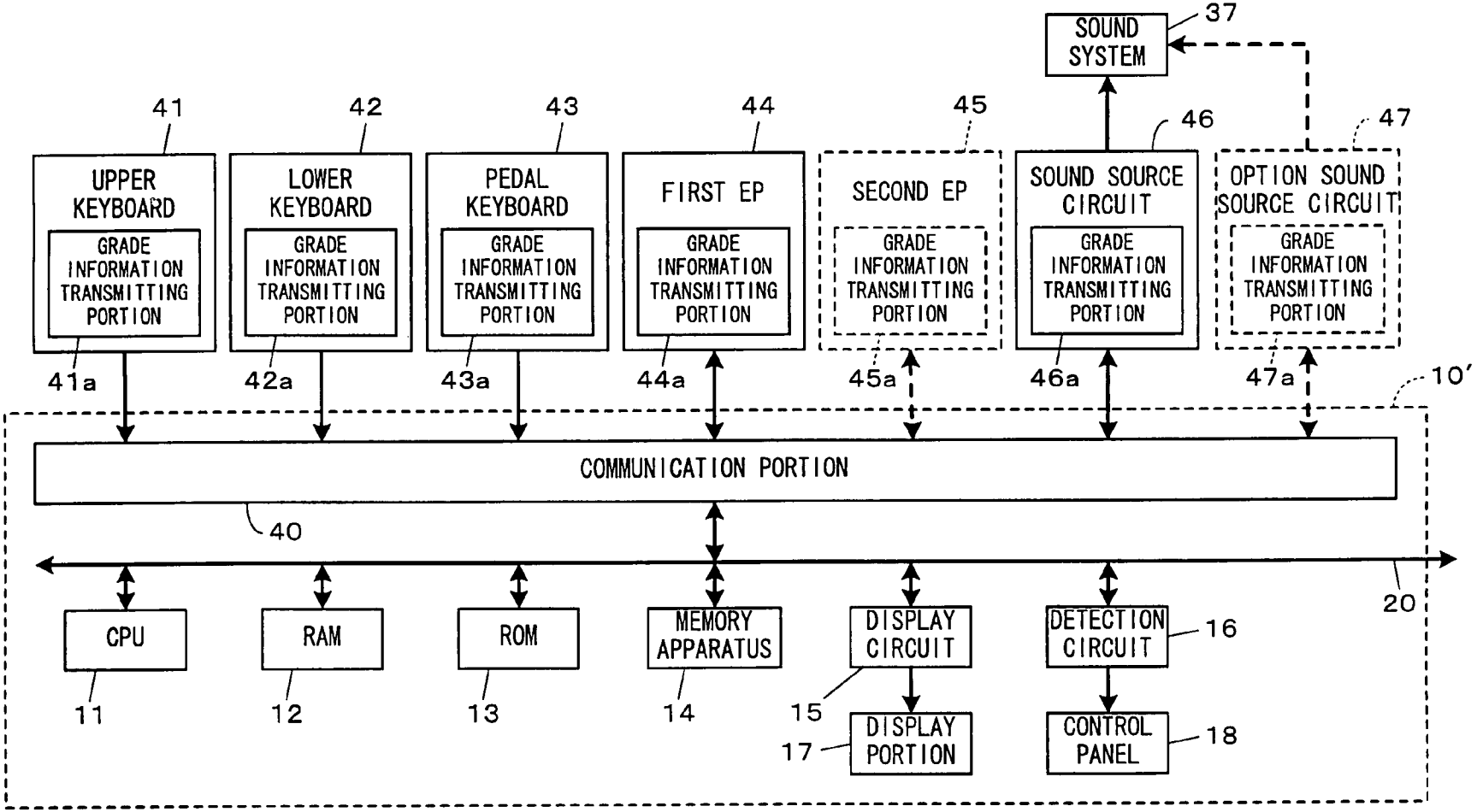
FIG. 6 is a block diagram showing a configuration of an electronic organ being a second embodiment of an electronic musical instrument of the invention.
Figure 7:
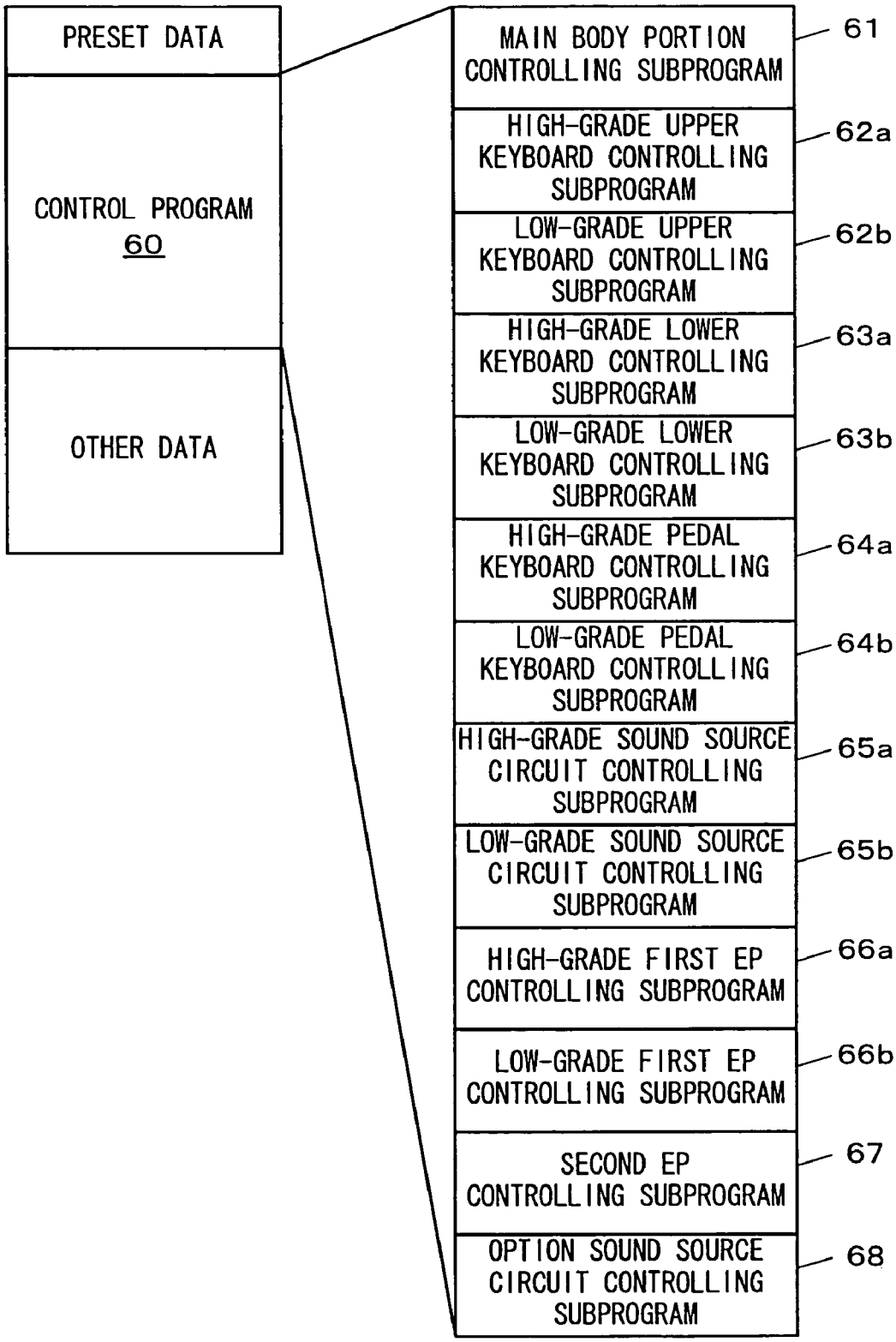
FIG. 7 is a diagram showing a configuration of data stored in a ROM of the electronic organ.
Figure 8:
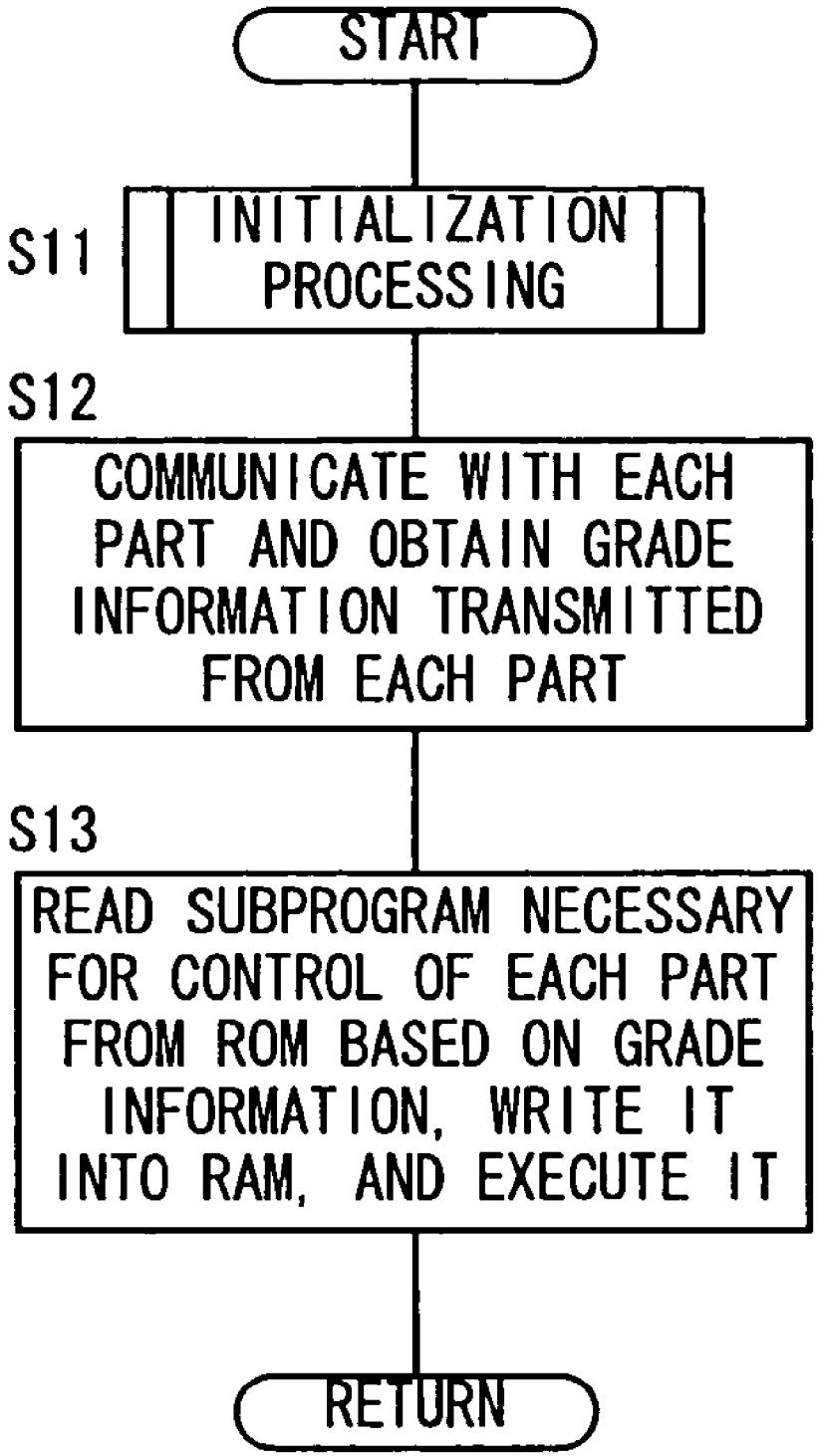
FIG. 8 is a flowchart showing control program selection processing in the electronic organ.

Second Embodiment FIG. 6 to FIG. 8

An electronic organ being a second embodiment of the electronic musical instrument of the invention will be described next. FIG. 6 is a block diagram showing a configuration of the electronic organ.

This electronic organ is also constituted, as in the first embodiment, by placing parts in a main body portion 10' shown in FIG. 6.

The configuration of the main body portion 10' is almost the same as that of the main body portion 10 in the first embodiment, but a communication portion 40 is provided in place of the detection circuits 21 to 26. The communication portion 40 is an apparatus for transmitting and receiving data between the main body portion 10' and the parts, and can be constituted using, for example, a communication interface in compliance with RS232C standard.

Parts 41 to 47 constituting the electronic organ have the same functions as those of the parts having the same names in the first embodiment, but are different therefrom in that sending/receiving data to/from the main body portion 10' side is performed by communication via the communication portion 40. Further, grade information transmitting portions 41*a* to 47*a* that transmit grade information representing their grades to the main body portion 10' side in response to an enquiry from the CPU 11 are provided in each kind of parts 41 to 47. These functions can be realized, for example, by one-chip microcomputer or CPU installed in each of the parts.

The electronic organ with the above-described configuration has a function as an electronic organ itself that is similar to that in the first embodiment. The capability of upgrade by replacement of only the parts is also the same, but in this embodiment it is possible to perform partial upgrade that is not limited to the model of a finished product by selecting a part for each kind and placing it in the main body portion 10'. This point will be described next. Note that description is made assuming that selectable grades are only a high-grade and a low-grade as in the first embodiment for simplification of description.

The ROM 12 of the electronic organ stores, as a control program 60, subprograms 61 to 68 as shown in FIG. 7. More specifically, the ROM 12 stores controlling subprograms for controlling parts of selectable grades for each kind of part as well as the main body portion controlling subprogram 61 for controlling the main body portion 10'. The CPU 11 selects a controlling subprogram corresponding to the part in accordance with the grade of each kind of part placed in the main body portion 10' as well as the main body portion controlling subprogram 61 and performs control using these programs.

The control program selected here is determined in accordance with grade information transmitted from the grade information transmitting portions 41*a* to 47*a* provided in the respective parts. For example, when receiving information from the upper keyboard 41 that it is of the high-grade, the CPU 11 selects and uses a high-grade upper keyboard controlling subprogram 62*a* as a program for use in control of the upper keyboard 41. Besides, when receiving information from the lower keyboard 42 that it is of the low-grade, the CPU 11 selects and uses a low-grade lower keyboard controlling subprogram 63*a* as a program for use in control of the lower keyboard 42.

For the parts that might not be placed depending on the grade such as the second EP 45 and option sound source circuit 47, corresponding control programs shall be selected only when they are placed. Besides, for the parts common in models of all grades such as the sound system 37, it is unnecessary to select the control program depending on the grade, and therefore it is unnecessary to provide the grade information transmitting portion.

The above-described selection processing is shown in the flowchart in FIG. 8.

When the power of the electronic organ is turned on, the CPU 11 executes a boot program included in the preset data to start the processing shown in the flowchart. Then, after performance of necessary initialization processing in Step S11, the CPU 11 controls the communication portion 40 to communicate with each of the parts 41 to 47 and obtain grade information transmitted from each of the grade information transmitting portions 41*a* to 47*a* provided therein in Step S12.

Then, in Step S13, the CPU 11 reads a subprogram necessary for control of each of the parts from the ROM 12 based on the grade information, writes it into the RAM 13, and then executes it to thereby start the control.

In the above-described electronic organ, both when only the parts of part of kinds are replaced and when all of the parts are replaced, the CPU 11 automatically recognizes the grade of each kind of part, selects a control program necessary for control of each part, reads it from the ROM 12 and executes it according to the processing shown in FIG. 8, so that the part can operate as an electronic organ. In such a case, since there is no need to perform operation at all other than the replacement of the parts, it is possible to shorten the work procedure at the time of upgrade and prevent a situation that the electronic organ becomes inoperable because of a mistake in changing setting or the like.

That different parameters may be read in accordance with the grade information to execute the control program and that the grades are not limited to the two kinds are the same as those in the first embodiment.

Further, when it is an assumption that all the parts are collectively replaced as in the first embodiment, it is also adoptable that the ROM 12 stores the control program 50 as shown in FIG. 2. In this case, it is preferable to provide the grade information transmitting portion in at least one of the parts to be replaced at the time of upgrade so that the CPU 11 selects a control program for use in control in accordance with the information transmitted from the grade information transmitting portion as in the first embodiment. Such arrangement can simplify the configuration and reduce the cost.

Conversely, it is also adoptable to use a switch such as the limit switch as in the first embodiment in place of the grade information transmitting portion. In other words, it is adoptable to provide a limit switch corresponding to each part so that the CPU 11 selects a control program for use in control of each part in accordance with the state of each switch. In this case, the shape of each part is changed or the like for each grade, so that when a part is placed in the main body portion, the switch is brought into a state corresponding to the grade of the part.

Figure 9:
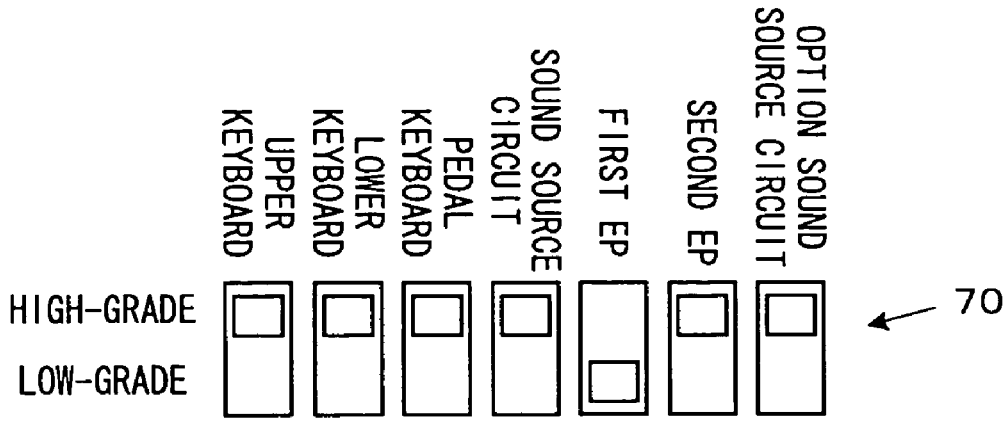
FIG. 9 is a diagram showing a configuration of a DIP switch group provided in an electronic organ being a third embodiment of an electronic musical instrument of the invention.
Figure 10:
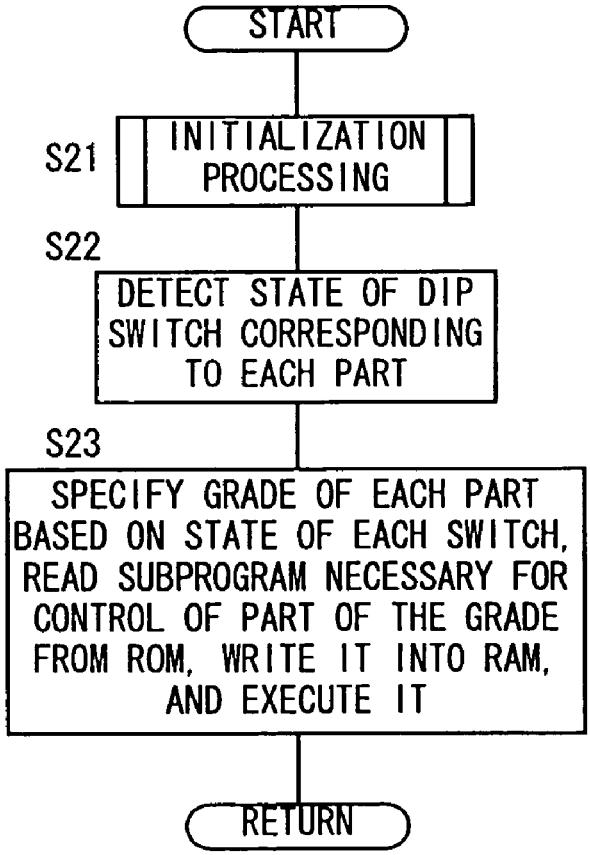
FIG. 10 is a flowchart showing control program selection processing in the electronic organ.

Third Embodiment FIG. 9 and FIG. 10

An electronic organ being a third embodiment of the electronic musical instrument of the invention will be described next.

The hardware configuration of this electronic organ is almost the same as that of the first embodiment that has been described using FIG. 1, and the control program stored in the ROM 12 is the same as that of the second embodiment that has been described using FIG. 7.

Further, in place of the limit switch 36 shown in FIG. 1, a DIP switch group 70 as shown in FIG. 9 is provided. This DIP switch group 70 is provided on a mother board of this electronic organ or connected to the mother board, and is composed of DIP switches corresponding to part units. Then, the DIP switch corresponding to each part is switched, whereby the CPU 11 can set a control program for use in control.

The CPU 11 selects a control program for use in control in accordance with the setting at the time of start, and this processing is shown in the flowchart of FIG. 10. This processing is the same as the processing shown in FIG. 8 except that the CPU 11 selects a program for use in control based on the state of each of DIP switches of the DIP switch group 70 in place of the data from the grade information transmitting portions 41*a* to 47*a*.

Also in the above-described electronic organ, the CPU 11 automatically selects a control program necessary for control of each kind of part and executes it as in the second embodiment, so that the part can operate as an electronic organ, and consequently the CPU 11 can cope with upgrade of only part of the parts.

Although it is necessary to manually switch the DIP switch at the time of replacement of the parts, an apparatus can be made at a low price as compared with the case of providing the grade information transmitting portion as in the second embodiment.

It should be noted that the kind and grade of the parts shown in the above-described embodiments are merely examples, and thus the present invention is not limited to these. For example, the display portion 17 and control panel 18 may also be treated as parts.

Besides, the electronic organ has been described as embodiments of the electronic musical instrument of the invention, but the invention is not limited to this and is naturally applicable to other keyboard instruments such as a piano, a synthesizer, and the like, and still other many kinds of electronic musical instruments such as the strings, the winds, the percussion, and so on having various structures. In this case, the parts are, of course, different in accordance with the kind of the electronic musical instrument.

As has been described, according to the electronic musical instrument of the invention, it is possible to reliably change the control program for use in control to an appropriate one when the grade of the electronic musical instrument is changed by replacement of the parts, and to make no change in other cases. Further, if the control program is stored for each kind of the parts so that the controller selects a control program necessary for control, whereby even when part of the parts are replaced, the control program can be changed to an appropriate one for performance of control.

TABLE 1

| KIND OF PART | HIGH-GRADE MODEL | LOW-GRADE MODEL |
|---|---|---|
| UPPER KEYBOARD | HIGH-GRADE | LOW-GRADE |
| LOWER KEYBOARD | HIGH-GRADE | LOW-GRADE |
| PEDAL KEYBOARD | HIGH-GRADE | LOW-GRADE |
| FIRST EP | HIGH-GRADE | LOW-GRADE |
| SECOND EP | WITH | WITHOUT |
| SOUND SOURCE CIRCUIT | HIGH-GRADE | LOW-GRADE |
| OPTION SOUND SOURCE CIRCUIT | WITH | WITHOUT |
| SOUND SYSTEM | COMMON | COMMON |

What is claimed is:

1. An electronic musical instrument comprising a main body portion and at least one part selected from among parts of a plurality of grades in accordance with a model of said electronic musical instrument and placed in said main body portion, wherein said main body portion comprises:

a memory for storing control programs necessary for control of said electronic musical instrument for respective models of said electronic musical instrument;

a controller for controlling said electronic musical instrument using a control program; and a selector for selecting a control program to be used for control by said controller from among the control programs stored in said memory, and wherein said selector comprises a switch provided to correspond at least to one of said parts and coming into a state in accordance with the grade of said part when said part is placed in said main body portion.

2. An electronic musical instrument according to claim 1, further comprising a restraining member corresponding to said switch, wherein said switch comes into a state in accordance with the grade of said part in accordance with a position of said restraining member.

3. An electronic musical instrument according to claim 2, wherein said selector selects a control program used for control by said controller in accordance with the position of said restraining member.

4. An electronic musical instrument according to claim 2, wherein said restraining member presses said switch so that said switch comes into a state in accordance with the grade of said part corresponding to said switch.

5. An electronic musical instrument according to claim 4, wherein pressing said switch by said restraining member shows that said part is of a high-grade.

6. An electronic musical instrument according to claim 1, wherein when said part is placed in said main body portion, said part itself presses said switch to bring said switch into a state in accordance with the grade of said part.

7. An electronic musical instrument comprising a main body portion and at least one part selected from among parts of a plurality of grades in accordance with a model of said electronic musical instrument and placed in said main body portion, wherein said main body portion comprises:

a memory for storing control programs necessary for control of said electronic musical instrument for respective models of said electronic musical instrument; and a controller for controlling said electronic musical instrument using a control program, wherein said part comprises a transmitter for transmitting information of the grade of said part to said main body portion, and wherein said controller comprises a selector for selecting a control program for use in control from among the control programs stored in said memory in accordance with the information transmitted by said transmitter.

8. An electronic musical instrument according to claim 7, wherein said part includes a CPU as said transmitter so that the CPU communicates with said main body portion to transmit the grade information of said part to said main body portion.

9. An electronic musical instrument comprising a main body portion and a plurality of parts selected from among parts of a plurality of grades for each kind and placed in said main body portion, wherein said main body portion comprises:

a memory for storing control programs for controlling said parts of each selectable grade for said each kind of part; and a controller for controlling said electronic musical instrument using a control program, and wherein said each kind of part comprises a transmitter for transmitting grade information of said part to said main body portion, and wherein said controller comprises a selector for selecting a control program for use in control from among the control programs stored in said memory in accordance with the information transmitted by said transmitter for said each kind of part.

10. An electronic musical instrument according to claim 9, wherein said each kind of part comprises a CPU as said transmitter so that the CPU communicates with said main body portion to transmit the grade information of said part to said main body portion.

11. An electronic musical instrument comprising a main body portion and a plurality of parts selected from among parts of a plurality of part grades for each kind and placed in said main body portion, wherein said main body portion comprises:

a memory for storing control programs for controlling said parts of each selectable part grade for said each kind of part;

a controller for controlling said electronic musical instrument using a control program; and a switch for selecting for said each kind of part a control program to be used for control by said controller from among the control programs stored in said memory.

12. An electronic musical instrument comprising a main body portion and a plurality of parts selected from among parts of a plurality of part grades for each kind and placed in said main body portion, wherein said main body portion comprises:

a memory for storing control programs for controlling said parts of each selectable part grade for said each kind of part; and a controller for controlling said electronic musical instrument using a control program and recognizing part grades of the parts placed in said main body portion for each kind, and wherein said controller comprises a selector for selecting a control program for use in control from among the control programs stored in said memory in accordance with the recognized grades for said each kind of part.

13. An electronic musical instrument according to claim 11, wherein said switch is provided to correspond to each kind of said parts and comes into a state in accordance with the part grade of said part when said part of the corresponding kind is placed in said main body portion.

* * * * *